United States Patent [19]

Ewing

[11] Patent Number: 4,727,453

[45] Date of Patent: Feb. 23, 1988

[54] ALTERNATING CURRENT INDUCTIVE CHARGING OF A PHOTORECEPTOR

[75] Inventor: Joan R. Ewing, Fairport, N.Y.

[73] Assignee: Xerox Corporation, Stamford, Conn.

[21] Appl. No.: 945,155

[22] Filed: Dec. 22, 1986

[51] Int. Cl.[4] ..... G03G 13/15

[52] U.S. Cl. ..... 361/225; 355/3 CH; 250/326

[58] Field of Search ..... 361/225, 230, 229; 355/3 CH, 3 R, 3 DD; 250/324–326; 430/120

[56] References Cited

U.S. PATENT DOCUMENTS

| | | | |
|---|---|---|---|
| 3,084,061 | 4/1963 | Hall | 250/325 |
| 3,147,415 | 9/1964 | Oliphant | 361/229 |
| 3,172,024 | 3/1965 | Gundlach | 361/225 |
| 3,626,260 | 12/1971 | Kimura | 361/225 |
| 3,684,364 | 8/1972 | Schmidlin | 355/3 |
| 4,380,384 | 4/1983 | Ueno et al. | 355/3 CH |
| 4,459,009 | 7/1984 | Hays et al. | 361/225 |
| 4,545,669 | 10/1985 | Hays et al. | 355/3 R |
| 4,666,801 | 5/1987 | Kimura et al. | 430/120 X |

OTHER PUBLICATIONS

IBM TDB; "Apparatus for Charging Xerographic Plates"; C. T. Ranpolph & J. W. Brookman; vol. 8, No. 12, May 1966, p. 1729.

Proceedings of the National Electronics Conference, "High Speed Printing of Cathode Ray Tube Information by Electrostatic Photography Techniques"; Straughan et al, vol. 13, p. 959, 1958.

*Primary Examiner*—L. T. Hix
*Assistant Examiner*—D. Rutledge
*Attorney, Agent, or Firm*—Mark Costello

[57] ABSTRACT

A charging system for a reproduction machine is provided comprising a photoreceptor member having the property of dark injecting only a single side of mobile carrier from an injection layer; an alternating current voltage source operating at a frequency f; and a bias roller charging member electrically connected to the alternating current voltage source and comprised of a deformable conductive material supported in deforming engagement with the photoreceptor member during relative movement of the photoreceptor and the bias roller charging member. The bias roller is maintained in contact with any given area on the photoreceptor for a period greater than or equal to 1/f the bias roller charging member to provide uniform charging and avoid strobing.

7 Claims, 3 Drawing Figures

ALTERNATING CURRENT INDUCTIVE CHARGING OF A PHOTORECEPTOR

This invention is directed generally to photoreceptor charging apparatus, and more particularly to bias roll induction charging with an alternating current voltage source.

INCORPORATION BY REFERENCE

The following U.S. patents are incorporated herein by reference for the purpose of background information: U.S. Pat. Nos. 3,147,415 to Oliphant; 3,084,061 to Hall; 3,172,024 to Gundlach; and 4,297,424 to Hewitt.

BACKGROUND OF THE INVENTION

During reproduction processes such as electrophotography, it is necessary to charge a photoconductive surface of a photoreceptor member to a uniform level, which charge will subsequently be selectively dissipated by exposure to light. The non-discharged portions retain their charge in the form of a latent image on the photoconductive surface, and when subsequently brought into contact with toner material, will retain toner on the surface of the photoreceptor in the areas where the charge has not been dissipated. At a later time, a final support member, such as paper, transparencies, etc. may be brought into contact with the photoconductive surface, and a charge applied to the backside of the support material will attract toner on the photoconductive surface to the support material. The toner on the support material may then be fused thereto to provide a permanent image on the support material.

In the past, the primary method of charging a photoconductive surface of a photoreceptor member in an electrophotographic device to a uniform level has been to provide a corotron charging system including a corona discharging wire or needle arrangement closely adjacent to the photoreceptor and extending transversely across its path of travel in conjunction with a high voltage power supply generally operating at a level in the range of approximately ±5000 to 8000 volts. This arrangement, while commonly used, has significant drawbacks in that it requires an expensive power supply, creates significant amounts of ozone deleterious to the photoreceptor surface, and results in an undesirable high voltage potential across an air gap of about 0.5 inches which may be hazardous to users of the device. In a similar manner, contacting roller members may be used to apply a charge to the photoreceptor, as shown by U.S. Pat. Nos. 3,626,260, to Kimura et al and 4,380,384 to Ueno et al, IBM Technical Disclosure Bulletin, "Apparatus for Charging Xerographic Plates" by Randolph and Brookman, Vol. 8, No. 12, page 1729, (May 1966), and Proceedings of the National Electronics Conference, "High Speed Printing of Cathode Ray Tube Information by Electrostatic Photography Techniques" by Straughan and Mayer, Vol. 13, page 959, (1958). Such contacting roller arrangements must also be driven at relatively high voltages. Significant cost advantages may be obtainable if expensive power supply and ozone suppression requirements could be eliminated.

A potential substitute for such an arrangement is induction roll charging. Induction roll charging is known, for example, as shown in U.S. Pat. Nos. 3,684,364 to Schmidlin, 3,172,024 to Gundlach or 3,084,061 to Hall, in which a bias roller charging member is arranged in rolling engagement with a photoreceptor surface, applying a field to the photoconductor whereby charge is induced on the photoconductive surface by causing a migration of charge carriers from an injecting interface to an area adjacent the photoreceptor surface. Such a charging arrangement allows significant reductions in the voltage requirements of the system, to voltages levels on the order of −100 to −500 volts, and produce essentially no ozone. Additionally, since the charging operation of the bias roller arrangement is to induce current to flow from a hole injecting substrate layer underlying the photoconductive surface, there is only a minimal amount of leakage current drawn from the bias roller power supply. A bias roller charging arrangement may offer additional significant advantages over corotron charging methods if the arrangement can be provided with an alternating current power source with preferably line voltage output levels and operating frequency. However, problems in the use of an alternating current (A.C.) power source, described in Oliphant U.S. Pat. No. 3,147,415, including strobing or banding of the charge level induced along the photoconductive surface, create problems in the implementation of induction roll charging.

SUMMARY OF THE INVENTION

It is accordingly the primary object of the invention to provide an improved arrangement for charging a photoreceptor in a reproduction machine preparatory to exposure to light images.

It is another object of the invention to provide an A.C. driven induction roll charging arrangement for inducing a charge on a photoreceptor without the problems of strobing or banding.

It is still another object of the invention to provide a charging arrangement operable at standard line voltages and frequencies, without the need of a voltage or frequency transformer.

In accordance with the invention, there is provided an induction roll charging arrangement for use in charging a photoreceptor of a reproduction machine, including a bias roller charging member comprising a deformable conductive material supported in rolling and deforming engagement with the photoreceptor member and maintained in contact with any given area on the photoreceptor for a period greater than or equal to 1/f. The bias roller charging arrangement is electrically connected to an alternating current voltage source operating at a frequency f whereby contact between the photoreceptor and the bias roller charging member induces charge to migrate from an injection layer of the photoreceptor through a photoconductive material layer to an area near the surface of the photoconductive material layer of the photoreceptor. The photoconductive material layer acts as a half wave rectifier accepting charge induced from the injecting layer only when the voltage wave is of a selected polarity, e.g. negative. During the period when the voltage signal is characterized by a non-selected polarity, no charge migration is induced by the engagement of the bias roller charging member with the photoreceptor surface. However, if the bias roller charging member is maintained in contact with the surface portion for a time in greater than the period of the voltage signal, satisfactory charging will be achieved since, at some point during the contact time, the voltage seen by any incremental portion will be of the selected polarity and voltage level.

In accordance with another aspect of the invention, a suitable alternating current voltage source operating at a frequency f is operable in a range of voltage levels and frequencies, including standard line output voltage and frequency, thus obviating the need for an expensive line transformer.

In accordance with yet another aspect of the invention, the relative velocity of the roller member and photoreceptor member required to avoid strobing at a selected frequency f is determinable by the size of the area of contact between the roller member and photoreceptor member.

These and other objects and advantages of the invention will become apparent as the following description is reviewed in conjunction with the accompanying drawings in which.

Figure 1:
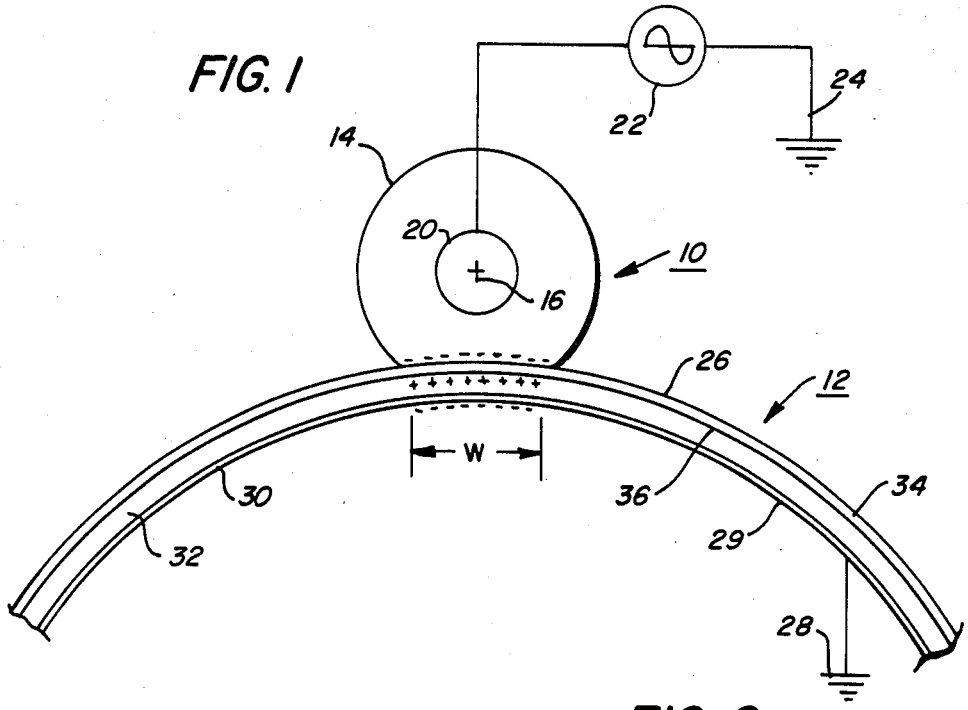
FIG. 1 is a somewhat schematic view of an A.C. bias roller charging arrangement in accordance with the invention and showing the electrostatic operation of the arrangement.

Referring now to the drawings, wherein the showings are for the purpose of illustrating a preferred embodiment of the invention and not for the purpose of limiting same, FIG. 1 shows an A.C. bias roll charging arrangement 10 in contacting engagement with a photoreceptor member 12. Bias roll charging arrangement 10 may be advantageously comprised of a conductive and deformable, elongated rubber roll member 14 supported for rotating movement about an axis 16, arranged transversely across the direction of relative movement of the photoreceptor member 12, and bias roll charging arrangement 10. Rubber roll member 14 is preferably comprised of a polymer material such as, for example, Neoprene, E.P.D.M. rubber, Hypalon rubber, Nitrile rubber, Polyurethane rubber (polyester type), Polyurethane rubber (polyether type), Silicone rubber, Viton/-Fluorel Rubber or Epichlorohydrin rubber, or other similar materials having a D.C. volume resistivity in the range of $10^3$ to $10^7$ ohm-cm after suitable compounding with graphite or other conductive additives. These materials are chosen for the characteristic of deforming while in engagement contact with the photoreceptor member as well as for wearability, manufacturability within tolerance and economy. The deformability of the roller member 14 is important to provide a substantial nip width thereof in engagement relationship with the photoreceptor 12 at any time. In one embodiment of the invention, rubber roll member 14 is axially supported on a shaft 20 comprising a cylindrically shaped steel shaft member having a 0.5 inch (1.27 cm) diameter, with a smooth outer surface finish. Rubber roll member 14 may have an outer diameter of about 1.0 inch (2.54 cm), and an inner diameter conforming to shaft 20. It is possible that other roller arrangements will work equally as well, such as for example, a relatively thick conductive shaft with a relatively thin rubber roll member arranged thereon. Preferably, roll member 14 has as smooth a surface finish as possible on the outer surface that will contact photoreceptor member 12. A satisfactory surface smoothness will have a surface variation of less than 200–500 microinches (5–12 microns). Variances in the surface of the nip introduce non-uniformities in the charging process. The surface of rubber roll member 14 may be either molded or ground to the desired smoothness. During operation of the inventive arrangement, it may be desirable to apply a mold release agent to the roller member surface, which may advantageously comprise a Teflon/binder composition, such as that produced by McGee Industries, Inc. of Upper Darby, PA, and sold under the trademark McLube 1700, to prevent direct negative charge transfer from the roll member to a photoreceptor surface, and to increase lubricity of the surface during subsequent cleaning operations. Such negative charge transfer has the effect of introducing noise and eventually reducing the induced photoreceptor charge to a level unacceptable for electrophotographic reproduction.

An A.C. driving voltage may be supplied to roll member 14 from an A.C. voltage source 22 connected at a first side to rubber roll member 14 through shaft 20, and at a second side to a ground potential 24. The peak-to-peak voltage signal is selected based on the desired voltage to be induced on the photoreceptor surface. As will be described, it is possible to use a standard line voltage, although other voltage levels or voltage signal frequencies may be desirable in accordance with other limiting factors dependent on individual machine design, such as the desired charge level to be induced on the photoreceptor, or the speed of copying operations desired.

In accordance with the invention, a suitable photoreceptor member 12 has the property of dark injecting only one sign of mobile carriers from a injection layer, i.e. the photoreceptor member has a rectifying effect with respect to the A.C. voltage signal applied to rubber roll member 14, and allows injection of only a single charge polarity irrespective of the inducing voltage. With reference to FIG. 1, the charging process comprises the application of the A.C. voltage signal from the bias charging arrangement 10 to upper surface 26 of photoreceptor 12, which creates a voltage across the photoreceptor to ground 28. Photoreceptor member 12 may be provided with a conductive substrate 29, such as aluminum, connected to a ground potential, an injection layer 30, comprising a material such as gold or trigonal selenium, a photoconductive material layer 32 comprising a photoconductive insulator such as selenium or its alloys overlayed thereon, and a dielectric overcoating 34 forming outer or upper surface 26 of the photoreceptor member. Charge carriers from injection layer 30, migrate into the bulk of the photoconductor material layer 32, and towards the upper surface 36 of the photoconductive material layer where the charge will be trapped. When the A.C. voltage signal from voltage source 22 is of a negative polarity, as indicated by the minus signs (−) along the lowermost portion of roller member 14, in contact with a upper surface 26 of photoreceptor member 12, a positive charge indicated by plus signs (+) is induced near the upper surface 36 of the photoconductive material layer 32 suitable for charging the photoreceptor member preparatory to exposure. The thin dielectric overcoating 34 is desirable on either the roller member 14 or the photoreceptor 12 for a variety of reasons, including protection of the surfaces of roller member 14 or photoreceptor 12, or for a current limiting action which may allow the use of low resistivity rollers, or for photoreceptor or roll member surface property control, and especially because the use of an overcoating allows operation of the device below corona thresholds, and so avoids strobing due to exit corona. In the embodiment shown in the drawings, overcoating 34 is provided on the upper surface of the photoreceptor. Alternatively, an overcoating may be provided on the outer surface of bias roller 14 for the same effect.

Figure 2:
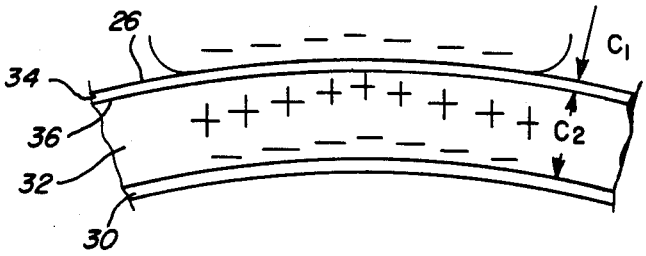
FIG. 2 is a somewhat schematic view of an A.C. bias roller charging arrangement and showing the physical characteristics of the invention.

The voltage level applied through bias roller 14 to photoreceptor surface 26 may be significantly less than the voltage desired on the surface of the photoreceptor for copying operations. Referring to FIG. 2, the charge applied to an area on the photoreceptor surface is shown by:

$$Q=C_1V_{app}=C_2V \quad (1)$$

where:

- Q is the charge on an incremental area of the photoreceptor surface 26;
- $C_1$ is the capacitance between the roller member and the photoreceptor member, approximately equal to the capacitance across the overcoating, neglecting air gaps;
- $V_{app}$ is the voltage of the roller member;
- $C_2$ is the capacitance across the photoconductive material layer between the injection layer surface and the photoconductive layer surface 36; and
- V is the voltage drop across the photoconductive material layer 32 after charging.

Thus, it may be seen that for a line voltage signal of 120 V, $C_1$ and $C_2$ are indicated by the common equations:

$$C_1=(\epsilon_0K_1A/T_1) \quad (2)$$

$$C_2=(\epsilon_0K_2A/T_2) \quad (3)$$

Where

- $\epsilon_0$ is the permittivity of free space;
- K is the dielectric constant of the space between the conductors, i.e., $K_1$ is the dielectric constant for the overcoating and $K_2$ is the dielectric constant of the photoconductive material;
- A is the area of the two conductors in consideration; and
- T is the spacing between the conductors, i.e., $T_1$ is the spacing across the overcoating, and $T_2$ is the spacing across the photoconductive layer.

For a $C_1$ wherein roller member 14 is in engagement with the overcoated photoreceptor surface 12, the dielectric constant $K_1$ of the overcoating is approximately 3, and spacing $T_1$ is approximately 6 microns while $C_2$ for a photoconductor such as a selenium alloy, the dielectric constant is approximately 10 and spacing $T_2$ is approximately 60 microns, while $\epsilon_0$ and A are the same for both capacitances. Substituting the relative values of $C_1$ and $C_2$ into Equation 1, it may be seen that the voltage of the charged photoreceptor may be as high as approximately 3 $V_{app}$. If $V_{app}$ is 120 $V_{RMS}$ (i.e., household or standard voltage), this level may suitably provide appropriate contrast on discharge thereof to form a latent image for electrophotographic copying.

It will no doubt be appreciated that the charging of the photoreceptor member surface occurs over time at the portion of the photoreceptor surface in contact with a selected area of the bias charging roller as the surface portion is moved by the roller in relative movement. Accordingly, and with reference to FIGS. 1 and 3, it can be seen that:

$$t=w/v \quad (4)$$

where:

- t is time or period in seconds available for charging a portion of a photoreceptor surface;
- w is nip width or the area of the roller member in contact with the photoreceptor surface; and
- v is relative velocity of the roller member with respect to the photoreceptor surface.

Figure 3:
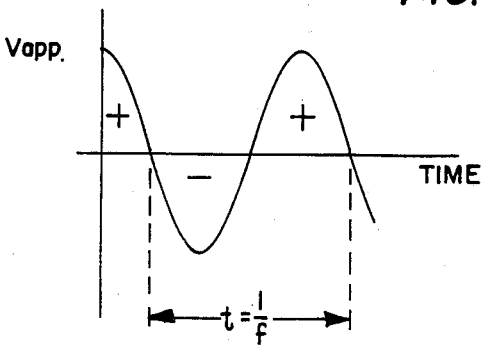
FIG. 3 is a graph showing one cycle of the applied A.C. voltage signal with respect to time.

Strobing, i.e. successive areas of varying voltage characteristics, has at least two causes. It can be caused by inducing a charge on a first photoreceptor surface portion by providing roller member 14 in contact with that portion during a period of the A.C. voltage signal passing through a selected polarity, while in a succeeding photoreceptor surface portion, inducing no charge because the A.C. voltage signal is passing through a period of non-selected polarity while roller member 14 is in contact with that portion of the photoreceptor surface. Accordingly, in order to provide a uniform charge on the photoreceptor surface, each incremental portion of the photoreceptor member surface is provided with a period of charging, or a period wherein the polarity of the driving voltage is of the selected polarity. As shown in FIG. 3, the selected area of the rubber roller 14 should be maintained in contact with any selected surface portion for a period greater than the period of the driving voltage frequency, or $$t=1/f \quad (5)$$

where f is the frequency of the A.C. voltage signal.

Thus, it may be seen for example, that for a roller member 14 which maintains a 0.25 inch wide contacting area with the photoreceptor surface portion at a line frequency of 60 Hz, $$1/60=0.25/v \quad (6)$$

which gives v as 15 inches per second, relative velocity of the roller member and the photoreceptor member. The surface width of the roller member 14 is determined by the hardness of the rubber material comprising the roller, and the engagement force between the roller member and the photoreceptor surface. The hardness or durometer of the material is chosen based on the desired width of contact, based on the desired frequency of the A.C. voltage source, and the desired relative velocity of the roller member with respect to the photoreceptor surface. Varying nip widths may be provided by varying the materials used for the roller. The allowable relative speed of the bias roller and the photoreceptor surface is varied in compensation for the varied nip width.

Strobing may also occur if the combination of induced and applied charges causes the field in the exit nip of the roller to exceed the corona threshold. Air breakdown will occur and deposit surface charges on the roller and photoreceptor. The amount of surface charge will be modulated by the A.C. applied voltage. If this occurs, it may be eliminated by making the overcoating thicker or reducing the peak applied voltage.

It will, of course, be appreciated that the time required for charging a photoreceptor to a given voltage level depends on the physics of the charge injection process, and the mobility of the injected charges in the photoreceptor. In other words, the invention depends on the use of a photoreceptor where charging for a period t is sufficient to charge the photoreceptor to a desired voltage level.

The invention has been described with reference to a preferred embodiment. Obviously, modifications will occur to others upon reading and understanding the specification taken together with the drawings. The described embodiments are only examples, and various alternatives, modifications, variations or improvements, may be made by those skilled in the art from this teaching which are intended to be encompassed by the following claims.

I claim:

1. An induction charging system for an electrophotographic device for charging a photoreceptor, said charging system comprising:

a photoreceptor including a conductive substrate, an injection layer, a photoconductive material layer for holding electrical charges of a selected polarity near an upper surface thereof, and a dielectric overcoating layer at a surface of said photoreceptor member to control the amount of induced charge;

an alternating current voltage source operating at a selected frequency f;

a bias roller charging member, said bias roller charging member comprised of a deformable conductive material supported in rolling and deforming engagement with said photoreceptor surface, and maintained in contact with any given area on said photoreceptor surface for a period greater than or equal to 1/f, said bias roller charging member electrically connected to said alternating current voltage source whereby contact between said photoreceptor and said bias roller charging member induces a uniform charge at said photoconductive material layer surface.

2. The charging system as defined in claim 1 wherein said alternating current voltage source is operated at a frequency f of approximately 60 Hertz.

3. The charging system as defined in claim 2 wherein said alternating current voltage source is operated at a voltage level approximately in the range of 115 to 125 Volts rms voltage.

4. A charging system for a reproduction machine for charging a surface of a photoreceptor member prior to exposure to light, including a photoreceptor member and an alternating current voltage source operating at a selected frequency f, said charging system comprising:

a photoreceptor member including a conductive substrate, an injection layer, a photoconductive material layer for holding electrical charges at an upper surface thereof, and a dielectric overcoating layer at a surface of one of said photoreceptor member and said roller member to control the amount of induced charge;

a bias roller charging arrangement electrically connected to said alternating current voltage source, and including a generally cylindrical elongated roller member supported for rolling movement about an axis transverse to the direction of relative movement of said bias roller charging arrangement and said photoreceptor member;

said roller member comprised of a deformable conductive material held in deforming engagement with a surface of said photoreceptor member to form a nip having a width W; and said deforming engagement maintaining a predetermined amount of surface area of said roller member at said nip in contact with any selected portion on said photoreceptor member surface for a period greater than or equal to 1/f whereby said bias roller charging arrangement induces a uniform charge at said photoreceptor member surface.

5. The charging system as defined in claim 4 wherein said period is proportional to the surface area of said roller member in contact with any selected portion on said photoreceptor member surface, and inversely proportional to the velocity of the relative movement of said roller member with respect to the photoreceptor surface.

6. The charging system as defined in claim 4 wherein said alternating current voltage source is operated at a frequency f of approximately 60 Hertz.

7. The charging system as defined in claim 4 wherein said alternating current voltage source is operated at a voltage level of approximately in the range of 115 to 125 Volts.

* * * * *